United States Patent [19]

Schmalz et al.

[11] 4,033,249

[45] July 5, 1977

[54] METHOD FOR FORMING BALES

[75] Inventors: Roman Schmalz, Milwaukee; Robert J. Wolf, Waukesha, both of Wis.

[73] Assignee: Logemann Brothers Company, Milwaukee, Wis.

[22] Filed: Jan. 2, 1976

[21] Appl. No.: 645,977

Related U.S. Application Data

[62] Division of Ser. No. 435,241, Jan. 21, 1974, Pat. No. 3,942,429.

[52] U.S. Cl. ..... 100/3

[51] Int. Cl.[2] ..... B65B 13/02

[58] Field of Search ..... 100/3, 7, 179, 191, 100/192, 187, 188 R

[56] References Cited

UNITED STATES PATENTS

| | | | |
|---|---|---|---|
| 651,018 | 6/1900 | Neely | 100/192 |
| 2,138,604 | 11/1938 | Jones | 100/188 R |
| 3,024,719 | 3/1962 | Englund | 100/192 X |
| 3,528,364 | 9/1970 | Freund | 100/192 X |
| 3,587,448 | 6/1971 | Hemphill | 100/3 |
| 3,762,311 | 10/1973 | Friedman | 100/192 X |

*Primary Examiner*—Billy J. Wilhite
*Attorney, Agent, or Firm*—Michael, Best & Friedrich

[57] ABSTRACT

Baling apparatus including a baling chamber and a compression ram mounted for reciprocal movement therein and a bale strapping chamber positioned adjacent the baling chamber. The cycle is started by positioning a strapped bale in the strapping chamber between upper and lower platform members. Bale material such as newspapers and cardboard is introduced into the baling chamber and the compression ram is reciprocated to progressively form a bale against one end of the strapped bale in the strapping chamber. During such bale forming operation the newly formed bale is gradually pushed between the upper and lower platform members to thereby force the strapped bale out from between such platform members on to a take-away conveyor. A pair of pivotally mounted gate members are mounted on opposite sides of the baling chamber at the exit thereof. The take-away conveyor can be tilted to separate the adjacent ends of the unstrapped and strapped bales. After the strapped bale has been completely pushed from the strapping chamber and separated from the unstrapped bale, the gate members are pivoted to retract position to expose all four sides of the completed but unstrapped bale in the strapping chamber. A strapping mechanism is then actuated to progressively install a series of horizontal straps tightly around the bale. When the bale has been completely strapped, the side gates are pivoted back to their closed position and the operation described above is repeated.

1 Claim, 9 Drawing Figures

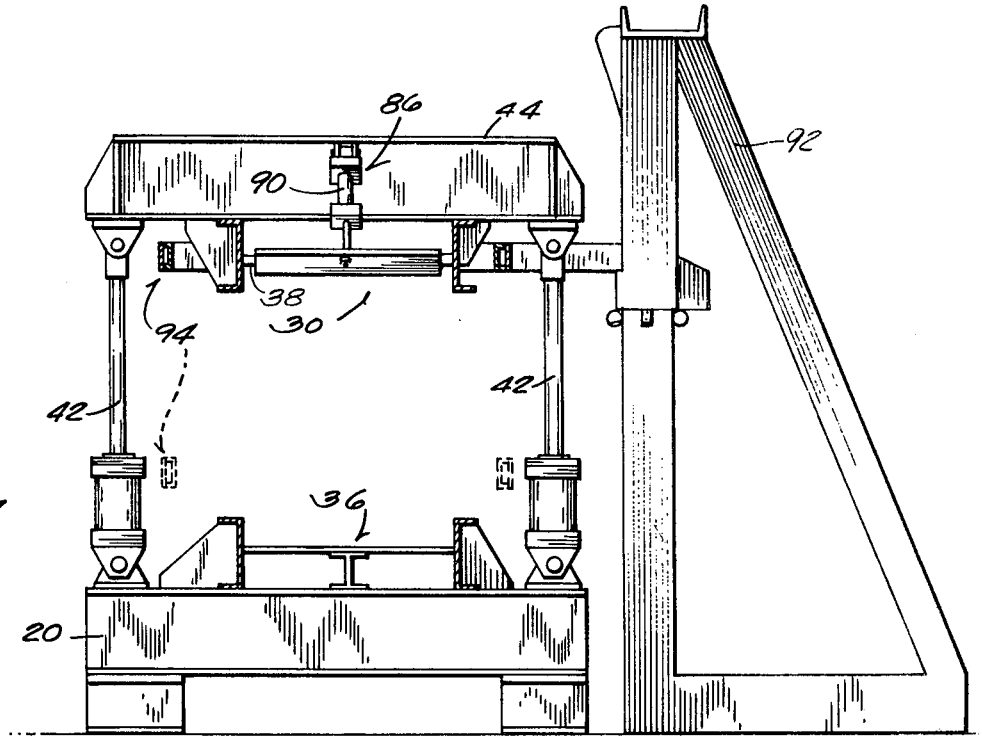
Fig. 7
Fig. 8
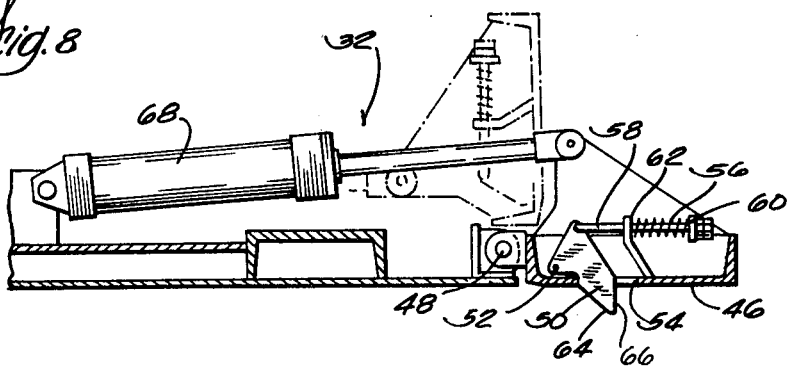

METHOD FOR FORMING BALES

CROSS-REFERENCE TO RELATED APPLICATION

This application is a division of our U.S. application, Ser. No. 435,241, filed Jan. 21, 1974 now U.S. Pat. No. 3,942,429.

BACKGROUND OF THE INVENTION

I. Field of the Invention

This invention relates to a method of forming a bale and more particularly relates to a method for forming and strapping bales of paper or other similar material.

II. Description of the Prior Art

As indicated above, this invention relates to a method which will form and strap a bale automatically with a minimum amount of manual attention. Prior automatic baling methods known to applicant are shown in U.S. Pat. NOs. 3,576,161 and 3,613,556. The present invention provides a considerably simplified method and therefore a method of considerably lower cost.

SUMMARY OF THE INVENTION

A method of forming a strapped bale comprising the steps of positioning a strapped bale between upper and lower restraining members with one end of the bale positioned adjacent the exit end of a baling chamber in which a compression ram is mounted for reciprocal movement. The exit end has a pair of bale material restraining gate members mounted on opposite sides thereof. The next step is to introduce bale materials into the baling chamber. The next step is to reciprocate the compression ram to progressively form a bale against one end of the strapped bale and at the same time push the newly formed bale between the upper and lower bale restraining members to thereby force the strapped bale out from between the upper and lower bale restraining members. The next step is to separate the adjacent ends of the unstrapped and strapped bales from each other after the strapped bale has been pushed completely out from between the upper and lower restraining members. The next step is to retract the bale material restraining gate members to expose all four sides of the unstrapped bale after it has been pushed between the upper and lower bale restraining members. The final step is to apply horizontal straps to the unstrapped bale.

DESCRIPTION OF THE DRAWINGS

FIG. 7 is a sectional view taken along line 7—7 of FIG. 2;

FIG. 8 is a fragmentary top plan view of one of the side gate mechanisms employed in the baling method of the present invention.

DESCRIPTION OF THE PREFERRED EMBODIMENT

Figure 1:
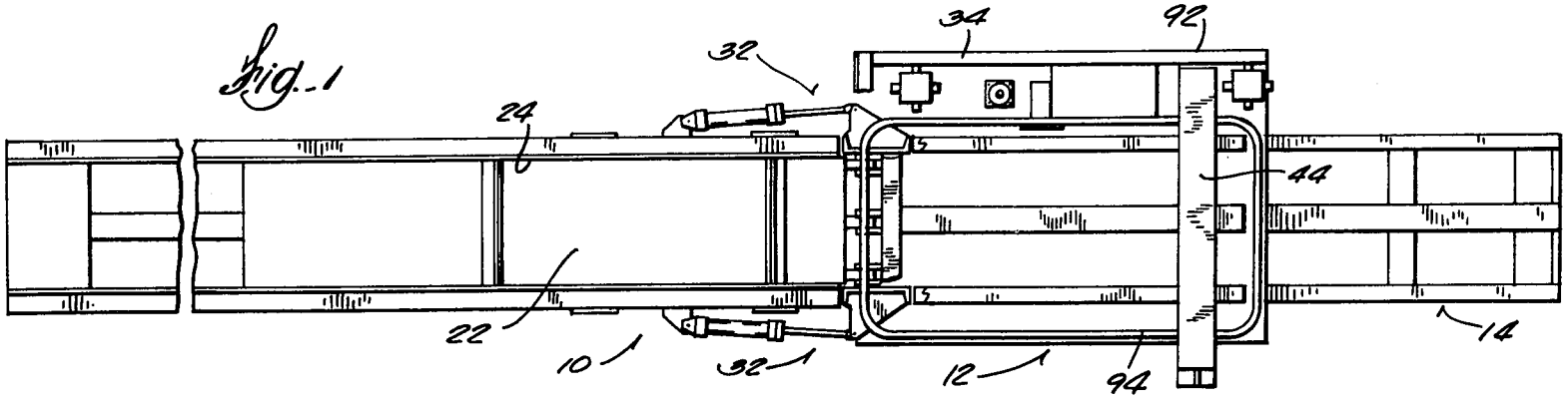
FIG. 1 is a top plan view of one embodiment of a baling apparatus for performing the method of the present invention.
Figure 2:
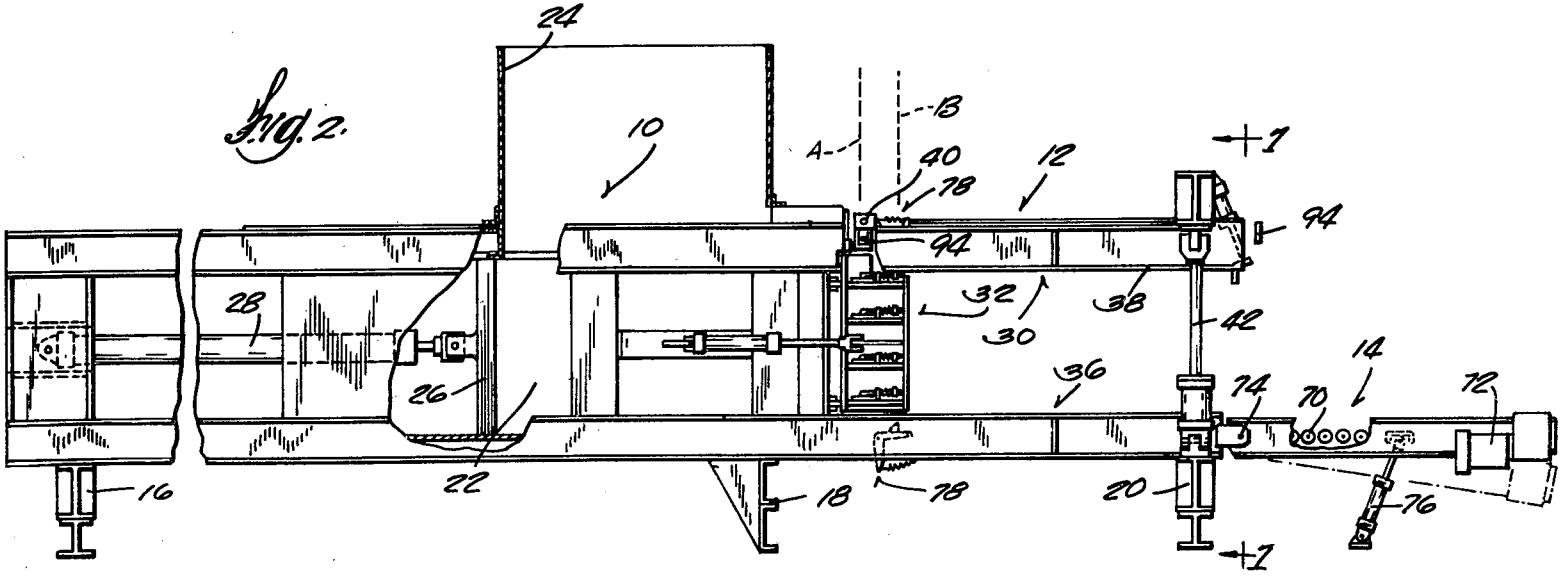
FIG. 2 is a side elevation view (with some parts broken away) of the baling apparatus shown in FIG. 1.

Referring to the drawings in detail, the baling apparatus shown in FIGS. 1 and 2 is comprised of three basic components, namely: a blae compression means 10, a bale strapping means 12 and a bale take-away conveyor means 14. As shown in FIG. 2, the baling apparatus is supported on suitable support members numbered 16, 18 and 20.

The bale compression means 10 is comprised of a baling or compression chamber 22 having a vertically extending feed chute 24 through which the material to be baled (such as paper or cardboard) is charged into the chamber 22. A compression ram 26 and hydraulic drive cylinder 28 of conventional design is mounted adjacent chamber 22. Bale compression means also includes a pair of side gate mechanisms 32, 32.

The strapping means 12 is comprised of a strapping chamber 30 and an automatic strapping mechanism 34. As best shown in FIGS. 2 and 7, strapping chamber 30 is comprised of a stationary lower deck structure 36 and a pivotally mounted upper deck structure 38. Deck 38 is pivotally mounted at the entrance end of chamber 30 by a pin 40 and is pivotally actuated by a pair of hydraulic cylinders 42, 42. Cylinders 42, 42 are pivotally mounted at the lower end of support member 20 and are pivotally connected at their upper ends to a transverse support member 44 which in turn is fastened to upper deck structure 38 by welding or other suitable means.

Side gate mechanisms 32 (FIG. 8) are of identical construction and are comprised of a gate member 46 pivotally mounted (by pins 48) on each side of the baling chamber 22 at the exit end thereof. Each gate member is equipped with four dog members 50 pivotally mounted on the outer faces of the gate members by pins 52. The end of each dog projects through openings 54 in the gate members and the dogs are biased to such projecting positions by springs 56 mounted on rods 58 between a shoulder 60 on the end of each rod and a bracket 62 fastened to the outer face of the gate members. As will be explained in greater detail hereinafter each dog member 50 is provided with a camming surface 64 and a restraining surface 66. Each gate member 46 is pivoted between an operating position as shown in solid lines in FIG. 8 and retracted position as shown in dotted lines in FIG. 8 by means of a hydraulic cylinder 68.

Figure 9:
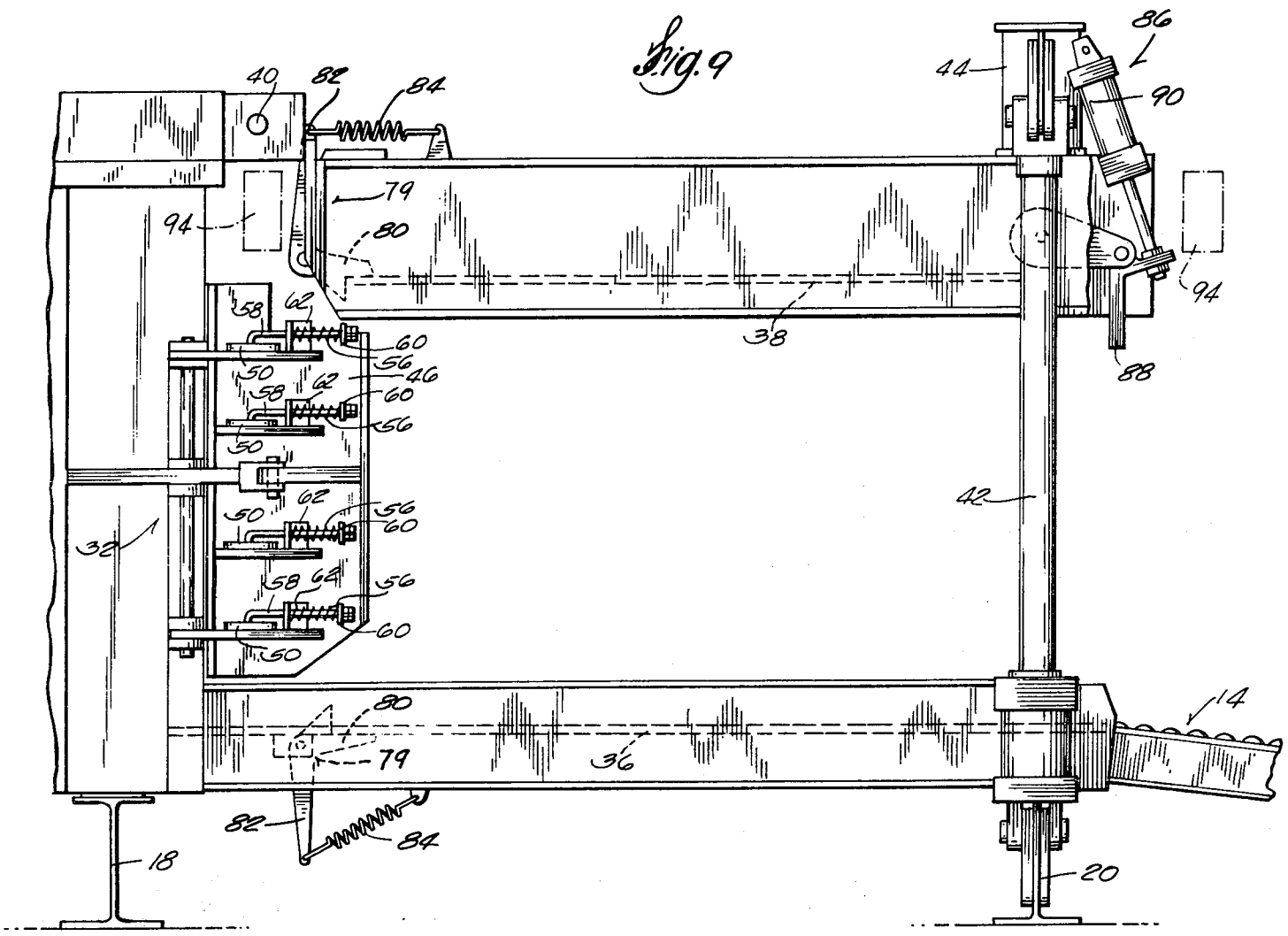
FIG. 9 is a fragmentary side elevation view of that portion of the baling apparatus in which the bale is strapped.

In addition to dog members 50 on gates 32, 32 the exit to the baling chamber 22 is also provided with pairs of upper and lower dog members 79, each of which is comprised of a pivotally mounted retaining dog member 80 having an arm 82 for connection to a biasing spring 84 (FIG. 9). A stop means 86 comprising a pivotally mounted stop member 88 actuated by a cylinder 90 is mounted at the exit of the strapping chamber 30 as best shown in FIG. 9. The function and operation of dogs 50 and 80 and stop member 88 will be described in detail hereinafter.

The particular construction of the automatic strapping apparatus 34 for strapping the bale in the strapping chamber is not a part of the present invention and thus is not shown or described in detail herein.

Briefly stated, strapping apparatus 34 is comprised of a strapping track 94 mounted on a support structure 92. Track 94 is automatically indexed to its designated vertically spaced positions (FIG. 7) at which positions straps 96 are applied to the bale and properly tensioned. The strap is then knotted by a twister pinion (not shown) to form a tie. The tie is then cut free from the supply wire and ejected from the slot of the twister pinion. Automatic strapping apparatus of the type suitable for use in the baling apparatus of the present invention is available from United States Steel Corporation and identified by the manufacturer as United State Steel Automatic Strapping Machine Model 238-00. A knotter mechanism suitable for use in the strapping apparatus is shown in U.S. Pat. No. 3,295,436.

The bale take-away conveyor means 14 is comprised of a powered conveyor mechanism 70 driven by a motor 72. The conveyor 14 is pivotally connected at one end to the outlet end of the strapping chamber 30 by pins 74, 74. The conveyor can be pivoted between the solid line position and the dotted line position of FIG. 2 by means of a hydraulic cylinder 76.

OPERATION

Figure 3:
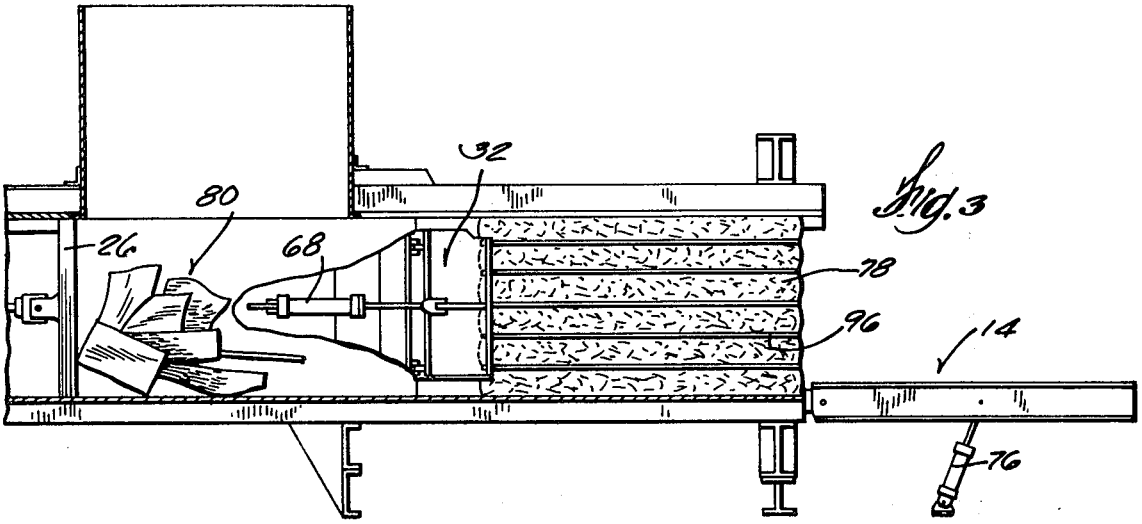
FIGS. 3, 4, 5 and 6 are fragmentary partially schematic side elevation views showing the sequence of operation of the baling method of the present invention.

Referring particularly to FIGS. 3–6, the description of the operation will be best understood by assuming the presence of a strapped bale 78 in the strapping chamber 30 as shown in FIG. 3. The making of the initial bale can be accomplished in any suitable manner such as temporarily blocking the outlet of the compression chamber with boards, then completely forming the initial bale in the compression chamber, then pushing the unstrapped bale into the strapping chamber and then operating the strapping mechanism 34 to strap the bale.

Referring now to FIG. 3, with a strapped bale 78 in the strapping chamber and with side gates 32 in closed or operating position and with stop member 88 in open position, material 80 is charged into the baling chamber 22 through feed chute 24. Ram 26 is then reciprocated to compress material 80 against the end of bale 78. It will be appreciated that as a new bale is being formed against the end of the strapped bale 78, bale 78 will be frictionally squeezed between upper and lower decks 38 and 36 of the strapping chamber with the pressure exerted on the bale being controlled by cylinders 42, 42 (see FIGS. 7 and 9).

Figure 4:
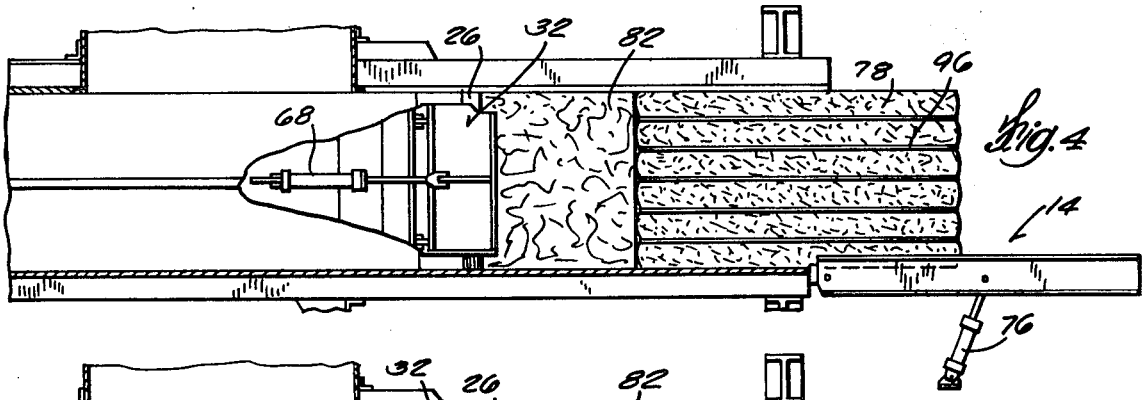

As shown in FIG. 4, as reciprocation of ram 26 is continued, the new bale 82 being formed against the end of bale 78 will progressively force bale 78 out of the strapping chamber and on to the take-away conveyor means 14. The operation of squeezing cylinders 42, 42 is coordinated with the operation of ram cylinder 28 by means of a suitable control system (not shown) so that when the ram cylinder pressure exceeds a given value, the pressure in the squeezing cylinders will be automatically reduced to permit the baling process to continue in a controlled manner to thereby form a bale of a predetermined bulk density.

It will also be noted that as new bale 78 is being formed, the material being moved past the inner surfaces of closed side gate members 46 during each power stroke of ram 26 will bear against cam surfaces 64 on dog members 50. The dog members will be thereby pivoted toward their retracted positions to thus permit free movement of the bale material in the power stroke direction. When the ram is retracted at the end of each power stroke, dogs 50 will be returned to their projecting positions by springs 56. In such position the restraining surfaces 66 on the dogs will restrain the tendency of the baled material to spring back into the compression chamber 22 at each side during each retracting stroke of the ram. During the above described bale forming or compression operation the ram in its forward or compression stroke will travel to the plane of restraining surfaces 66 on dogs 50 as indicated by the dotted line A on FIG. 2.

Figure 5:
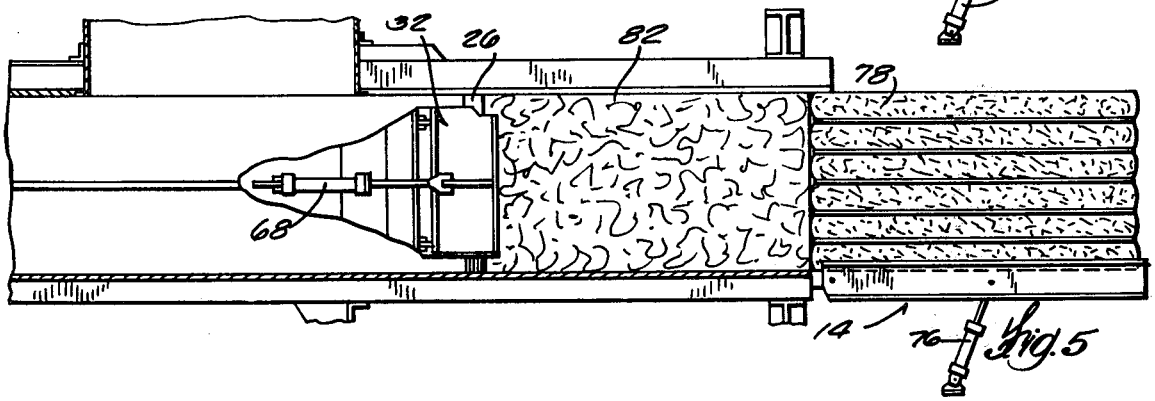

Reciprocation of ram 26 continues until a new bale 82 is completely formed. At this point ram 26 is activated to its maximum stroke position to thereby force new bale 82 completely into the strapping chamber (FIG. 5). During this stroke ram 26 will travel to the plane of dog members 80, as indicated by dotted line B on FIG. 2. This final movement of new bale 82 will push strapped bale 78 completely out of the strapping chamber onto the take-away conveyor 14 (FIG. 5). With the bales 78 and 82 positioned as shown in FIG. 5, the baler control system will actuate the conveyor tilt cylinder 76 and conveyor motor 72 to thereby tilt the conveyor to the FIG. 6 position and cause the bale to be transferred off the take-off conveyor onto some other conveyor means (not shown). The downward tilting of the take-away conveyor will separate the adjacent ends of the bales 78 and 82 and thereby facilitate the subsequent transfer of the strapped bale from the take-away conveyor.

Figure 6:
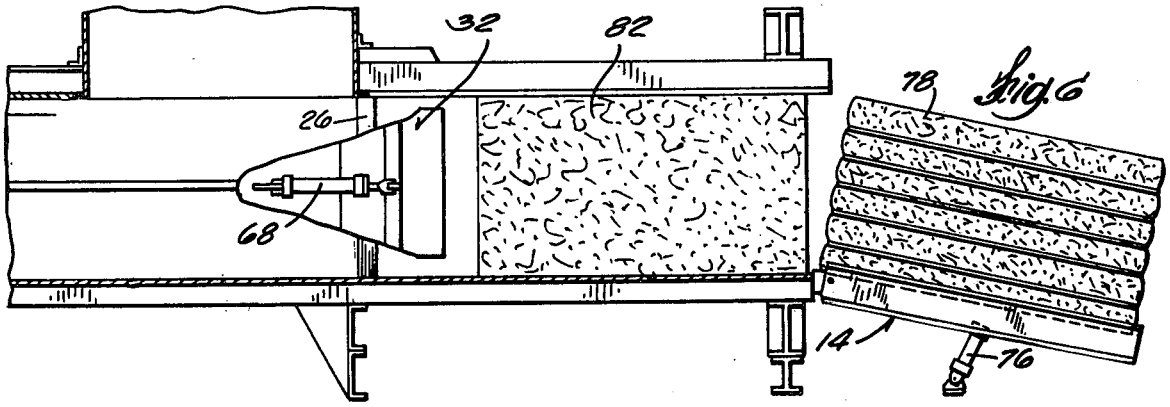

As the strapped bale is transferred from the baler as described above, side gates 32, 32 will be pivoted to their retracted positions by cylinders 68, 68. At the same time stop member 88 will be actuated to its closed position (FIG. 9) by cylinder 90. The closing action of stop member 88 will push any bale material sticking out the top end of the bale back into the bale and thus prevent any interference between the bale and the strapping track 94 in the subsequent operation of the strapping means 34. It will also be appreciated that when the unstrapped bale reaches strapping position (FIG. 5) dog members 80 will assume the position shown in FIG. 9 to thereby provide a restraining action on the left end of the bale. Thus with the strapped bale 78 removed and gates 32, 32 retracted, ram 26 is retracted to expose all four sides of the completed but unstrapped bale (FIG. 6). The strapping mechanism 34 is then actuated to thereby progressively install a series of horizontal straps 96 tightly around the bale. When the bale is completely strapped, gates 32, 32 will be pivoted back to their closed position, stop member 88 will be actuated to its open position and the operation described above is repeated.

I claim:

1. A method of forming a strapped bale comprising the steps of:

a. positioning a strapped bale between upper and lower bale restraining members with one end of the bale positioned adjacent the exit end of a baling chamber in which a compression ram is mounted for reciprocal movement, the exit end of the baling chamber having a pair of bale material restraining gate members mounted on opposite sides thereof;

b. introducing bale material into the baling chamber;

c. reciprocating the compression ram to progressively form a bale against said one end of the strapped bale and at the same time pushing the newly formed bale between the upper and lower bale restraining members to thereby force the strapped bale out from between the upper and lower bale restraining members;

d. separating the adjacent ends of the unstrapped and strapped bales from each other after the strapped bale has been pushed completely out from between the upper and lower bale restraining members;

e. retracting the bale material restraining gate members to expose all four sides of the unstrapped bale after it has been pushed between the upper and lower bale restraining members; and f. applying horizontal straps to the unstrapped bale.

* * * * *